US008033496B2

(12) United States Patent
Murase

(10) Patent No.: US 8,033,496 B2
(45) Date of Patent: Oct. 11, 2011

(54) ROLLED BODY HOLDER AND RECORDING APPARATUS

(75) Inventor: Tetsuya Murase, Chiba (JP)

(73) Assignee: Seiko I Infotech Inc. (JP)

( * ) Notice: Subject to any disclaimer, the term of this patent is extended or adjusted under 35 U.S.C. 154(b) by 266 days.

(21) Appl. No.: 11/991,115

(22) PCT Filed: Jul. 12, 2006

(86) PCT No.: PCT/JP2006/313844

§ 371 (c)(1),
(2), (4) Date: Jun. 3, 2009

(87) PCT Pub. No.: WO2007/026470

PCT Pub. Date: Mar. 8, 2007

(65) Prior Publication Data

US 2009/0256023 A1 Oct. 15, 2009

(30) Foreign Application Priority Data

Aug. 31, 2005 (JP) ..... 2005-251420

(51) Int. Cl.
*B65H 75/24* (2006.01)

(52) U.S. Cl. ..... 242/573; 242/573.1; 242/573.2; 242/573.8

(58) Field of Classification Search ..... 242/573, 242/573.1–573.2, 573.8, 575.3–575.5
See application file for complete search history.

(56) References Cited

U.S. PATENT DOCUMENTS

| | | | | |
|---|---|---|---|---|
| 2,280,370 | A * | 4/1942 | Bennett | 242/573.1 |
| 2,942,892 | A * | 6/1960 | Nelson | 242/573 |
| 3,552,673 | A | 1/1971 | Evers | 242/72.1 |
| 4,148,444 | A * | 4/1979 | Hehner | 242/571.3 |
| 7,175,128 | B2 * | 2/2007 | Korthauer | 242/571 |
| 2004/0011915 | A1 * | 1/2004 | Korthauer | 242/563.1 |

FOREIGN PATENT DOCUMENTS

| | | |
|---|---|---|
| DE | 3736753 | 8/1988 |
| GB | 1069589 | 5/1967 |
| GB | 2213128 | 8/1989 |
| JP | 48015123 | 4/1973 |
| JP | 08259055 | 10/1996 |
| WO | 03040012 | 5/2003 |

* cited by examiner

*Primary Examiner* — Sang Kim
(74) *Attorney, Agent, or Firm* — Adams & Wilks

(57) ABSTRACT

A rolled body holder includes a center shaft member serving as a lead screw connected to a handle, a cam member screwed to the center shaft member, and a plurality of segments which form a cylindrical body covering the center shaft member and the cam member. The cam member includes a plurality of rails, and each of the rails includes a cam surface with a radially varying height. Each of the segments includes a follower part fitted to the rail and relatively slidable along the cam surface and an outer surface part on which multiple projections are formed. When the cylindrical body is inserted into a paper tube of a rolled body and the handle is rotated, the center shaft member is rotated to move the cam member in the longitudinal direction. Then, a portion of the cam surface, which is higher in the radial direction, is brought into contact with the follower part, and each of the segments extends in the radial direction so that the projections bite into an inner surface of the paper tube. As a result, the rolled body can be easily and securely held with a simple structure.

9 Claims, 14 Drawing Sheets

(a)

(b)

ROLLED BODY HOLDER AND RECORDING APPARATUS

CROSS-REFERENCE To RELATED APPLICATIONS

This application is a U.S. national stage application of International Application No. PCT/JP2006/313844, filed Jul. 12, 2006, claiming a priority date of Aug. 31, 2005, and published in a non-English language.

TECHNICAL FIELD

The present invention relates to a rolled body holder and a recording apparatus including the same.

BACKGROUND ART

Conventionally, in a case of continuously providing a web material (continuous long recording medium) to an apparatus such as a printer, for example, there has been employed a structure for preparing a rolled body obtained by winding the web material and sequentially feeding the web material from the rolled body. In particular, in a case of a large printer, a large heavy web material is used in many cases. For this reason, the web material is wound around a paper tube, which is a core, to thereby form the rolled body. The paper tube is a cylinder made of a cardboard, synthetic resin, or the like, and is capable of holding the heavy web material without being largely deformed. Note that, the term "paper tube" is generally used, but it is not limited to a tubular member made of paper, and a tubular member or the like made of synthetic resin such as vinyl chloride is also widely used.

When a long support shaft penetrating the paper tube is provided so as to set the rolled body having the structure, in which the web material is wound around the paper tube, in the apparatus as described above, the apparatus is increased in size and an operation of mounting and dismounting the rolled body becomes complicated. Accordingly, there is used an apparatus for holding both end portions of the rolled body, particularly, both end portions of the paper tube.

As a device for holding the end portions of the rolled body, a mechanism for supporting the paper tube from an inside is generally used. However, in a case where there is a gap between an inner surface of the paper tube and the supporting mechanism, wobbling is caused when the web material is fed or wound. As a result, advancement and retraction of the web material cannot be smoothly performed, and there is a possibility that an edge portion of the web material is folded or a skew is caused. In general, an inner diameter of the paper tube is uniformly set to a specified dimension, for example, 3 inches (76.2 mm), but there is a possibility that an error of about several mm is produced. In such a case, a gap is formed between the inner surface of the paper tube and the supporting mechanism as described above, whereby the web material cannot be smoothly fed or wound.

In view of the above, Patent Document 1 (JP 05-77976 A), for example, proposes a device for holding the end portions of the rolled body without causing wobbling, by using a plurality of abutment members to be brought into press contact with the inner surface of the paper tube from the inside.

In the holder described in Patent Document 1 (JP 05-77976 A), the plurality of abutment members movable in the radial direction support the paper tube while being brought into press contact with the inner surface of the paper tube from the inside, thereby making it possible to eliminate the wobbling. However, in the holder, in the case of holding the paper tube, locking pawls are first disengaged from a gear, the holder is inserted into the paper tube, and the abutment members themselves are moved to be abutted against the inner surface of the paper tube. Then, the locking pawls are engaged with the gear again, thereby fixing the abutment members. A series of processes are manually performed, so the processes are quite troublesome. Further, Patent Document 1 does not disclose a mechanism for performing the process of manually moving the abutment members themselves to be abutted against the inner surface of the paper tube and the process of engaging the locking pawls with the gear again, in a state where the holder is inserted into the paper tube. If the mechanism can be realized, an extremely complicated structure may be required.

SUMMARY OF THE INVENTION

Therefore, it is an object of the present invention to provide a rolled body holder capable of firmly holding a rolled body by being brought into press contact with an inner surface of a paper tube without causing wobbling, with a simple structure and with ease through an operation from an outside, and to provide a recording apparatus including the rolled body holder.

A rolled body holder of the present invention includes: a cylindrical center shaft member; a cam member which is provided along a longitudinal direction of the center shaft member so as to be capable of advancing and retracting, and which has a cam surface with a radially varying height; and a plurality of segments each including: a follower part relatively slidable along the cam surface of the cam member; an outer surface part which forms a part of a cylindrical body covering the center shaft member and the cam member; and a plurality of projections formed on the outer surface part, the plurality of segments being incapable of moving in the longitudinal direction of the center shaft member and being capable of moving in a radial direction of the cylindrical body with relative sliding of the follower part along the cam surface.

With this structure, in accordance with relative sliding between the cam surface of the cam member and the follower part of each of the segments, the outer surface part can be extended in a radial direction. When the outer surface part is thus extended in the radial direction inside the paper tube of the rolled body, the plurality of projections bite into the inner surface of the paper tube, thereby making it possible to firmly hold the paper tube.

The projections preferably exist over substantially the entire surface of the outer peripheral surface of the cylindrical body. As a result, the rolled body can be held by substantially the entire cylindrical body formed of the plurality of segments, in a state of being substantially in contact on the surface, thereby preventing the rolled body from being obliquely held.

There can be further provided a flange for holding the center shaft member and the cam member so that the cam member can move within a predetermined range in a longitudinal direction of the center shaft member, and for holding the plurality of segments so that the outer surface parts form the cylindrical body covering the center shaft member and the cam part and so that each of the segments is incapable of moving in the longitudinal direction of the center shaft member and each of the segments is capable of moving within the predetermined range in the radial direction of the cylindrical body. In this case, an operation of advancing and retracting the cam member so as to extend each of the segments in the radial direction can be easily performed with the flange used as a base.

In addition, the center shaft member may be joined to a handle, which has a screw part and is disposed outside the flange, and the center shaft member may be rotated with the rotation of the handle and may advance or retract the cam member fitted into the screw part. In this case, only by the rotation of the handle positioned outside the flange, the rolled body can be easily held.

The cam surface of the cam member forms a part of a rail, and is mounted slidably and inseparably with respect to the rail. The flange may include a plurality of engaged parts along the radial direction of the flange, and the segments each may include engagement parts slidably engaged with the engaged parts. Alternatively, the follower part may be mounted so as to be brought into contact with the cam surface, and the segments each may include a plate spring part joined to the outer surface part, for urging the segment toward a position where the segment is retracted in the radial direction. In either structure, the operation of holding the rolled body by extending each of the segments in the radial direction and the operation of releasing the holding of the rolled body by retracting each of the segments in the radial direction can be repeatedly performed with ease.

Note that the segments are placed at positions where the segments retract in the radial direction in a state where the follower part is brought into contact with a portion of the cam surface, which is relatively lower in the radial direction, and the segments are placed at positions where the segments extend in the radial direction in a state where the follower part is brought into contact with a portion of the cam surface, which is relatively higher in the radial direction.

When a length of each cam surface in the longitudinal direction is equal to or larger than two-thirds of a length of each segment and each follower part in the longitudinal direction, the segments can smoothly extend or retract in the radial direction without causing scoring.

Further, the recording apparatus according to the present invention includes a rolled body holder having any one of the above-mentioned structures, and a recording part for performing recording on a recording medium fed from the rolled body held in the rolled body holder. By the use of the above-mentioned rolled body holder, the recording medium fed from the rolled body is prevented from skewing, and the recording medium can be smoothly supplied, whereby recording can be performed with high accuracy.

DETAILED DESCRIPTION OF THE INVENTION

Hereinafter, an embodiment mode of the present invention will be described with reference to the drawings.

Figure 1:
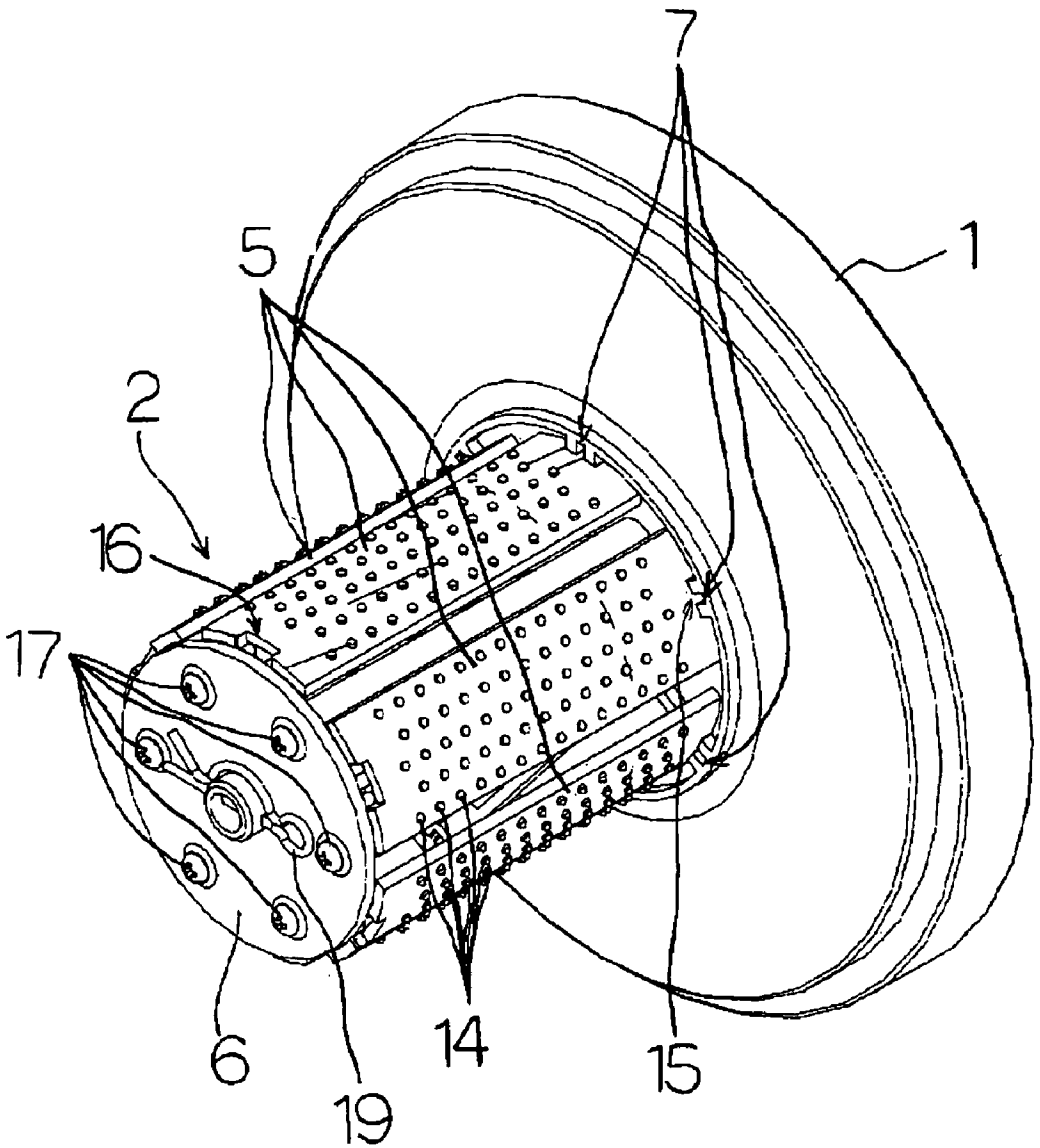
FIG. 1 is a perspective view showing a rolled body holder according to a first embodiment of the present invention.
Figure 2:
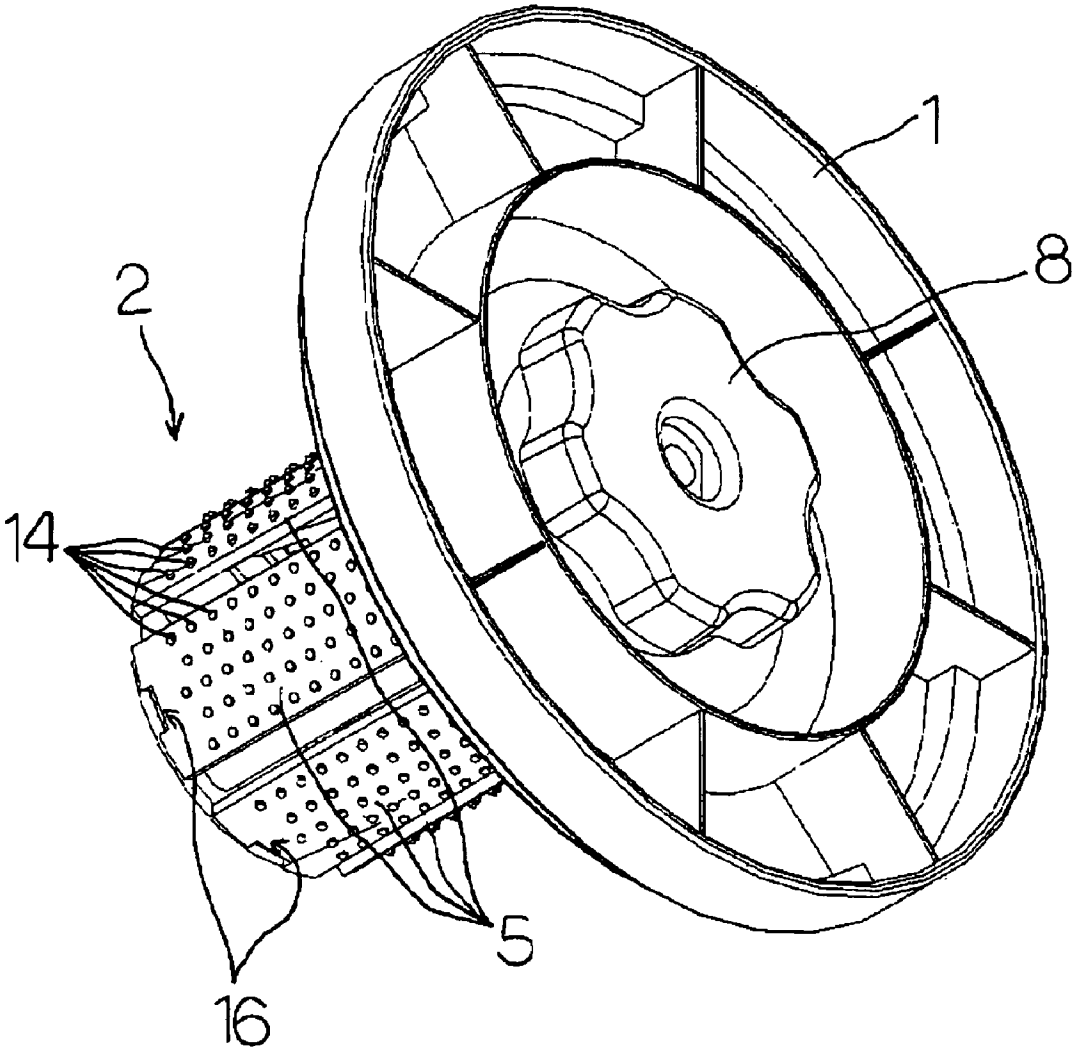
FIG. 2 is a perspective view of the rolled body holder shown in FIG. 1 viewed from a different direction.
Figure 3:
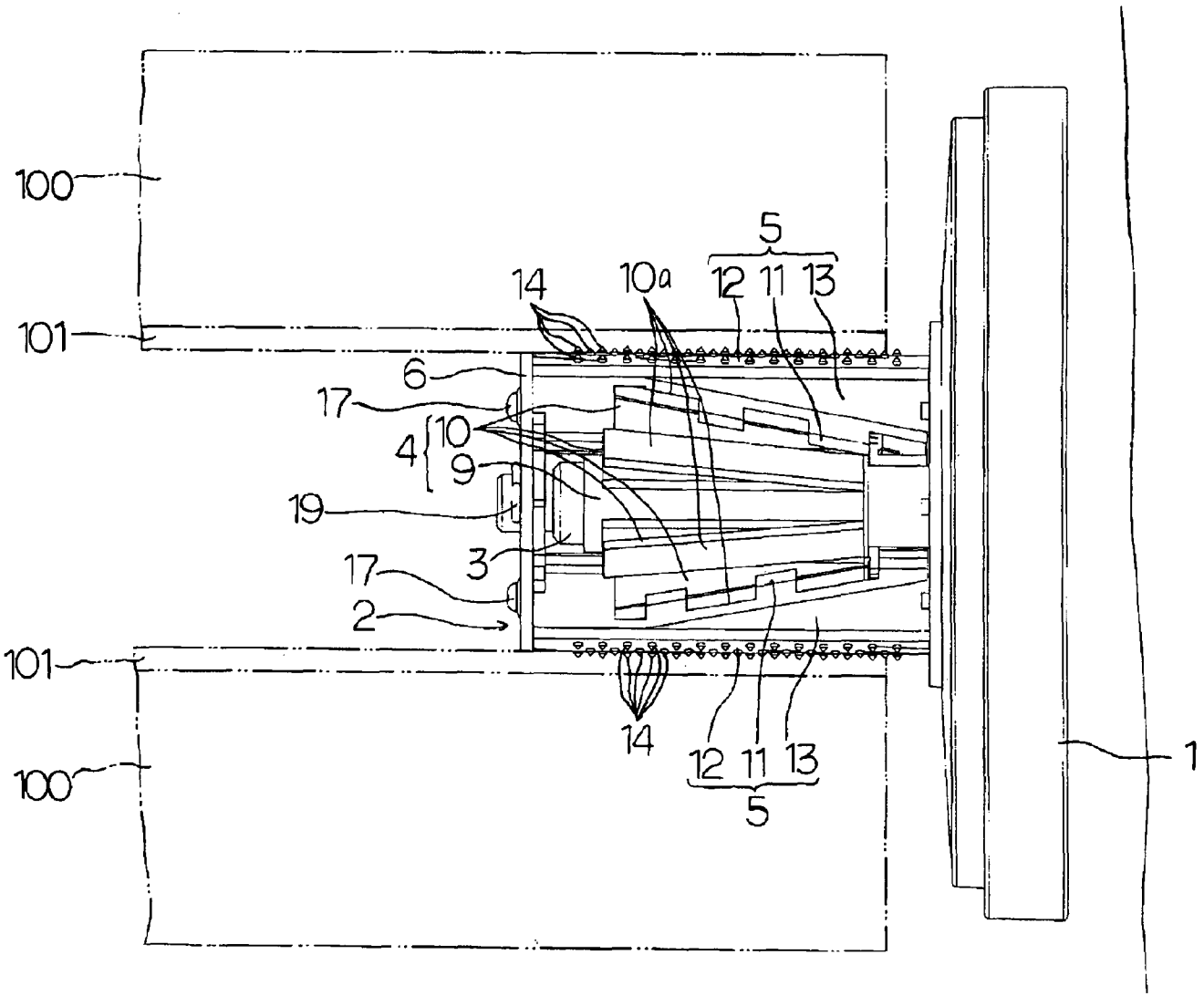
FIG. 3 is a front view of the rolled body holder shown in FIG. 1 in which a part of segments is omitted.

First, a description is given of a first embodiment of the present invention shown in FIGS. 1 to 8. FIGS. 1 to 3 each shows an entirety of a rolled body holder of this embodiment. The rolled body holder includes, as a basic structure, a disk-shaped flange 1, and a cylindrical body 2 which is projected from the flange 1 to be inserted into a paper tube 101 (see FIG. 3.) of a rolled body 100. Specifically, a center shaft member 3 (see FIG. 4), a cam member 4 (see FIG. 5) mounted to an outer periphery of the center shaft member 3, and a plurality of segments 5 (see FIG. 6) which form the cylindrical body 2 covering the center shaft member 3 and the cam member 4 are held between the flange 1 and a top plate 6.

The flange 1 may be fixed or may not be fixed to an apparatus such as a printer, and has engaged parts 7 provided on an inner surface of the flange 1 along a radial direction.

Figure 4:
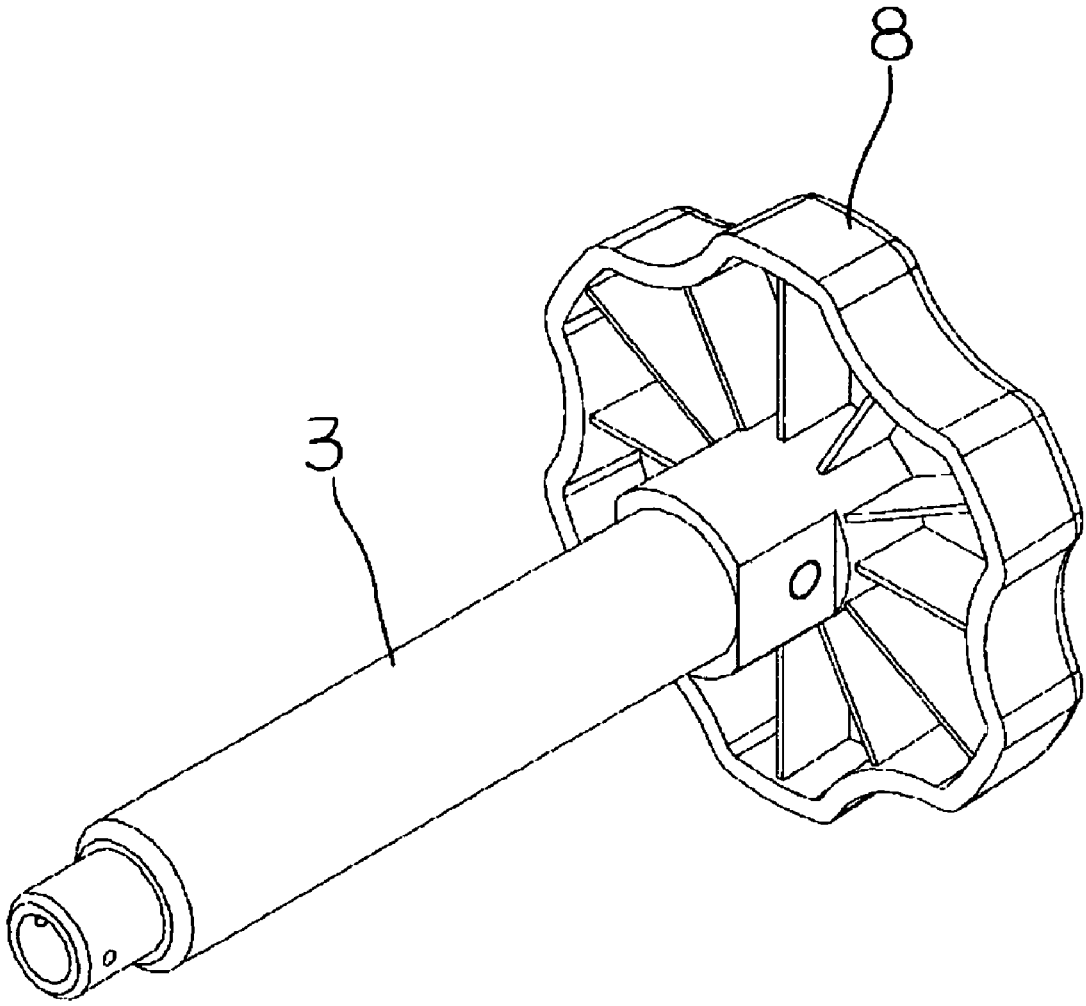
FIG. 4 is a perspective view showing a center shaft member of the rolled body holder shown in FIG. 1.

The center shaft member 3 shown in FIG. 4 is a lead screw which is provided with an external thread part not shown on an outer peripheral portion, is joined to a handle 8 disposed outside the flange 1, and is rotatable relatively with respect to the flange 1 and the top plate 6. Note that, FIG. 4 shows, for ease of explanation, a state in which the center shaft member 3 and the handle 8 are directly joined to each other while the flange 1 is omitted.

Figure 5:
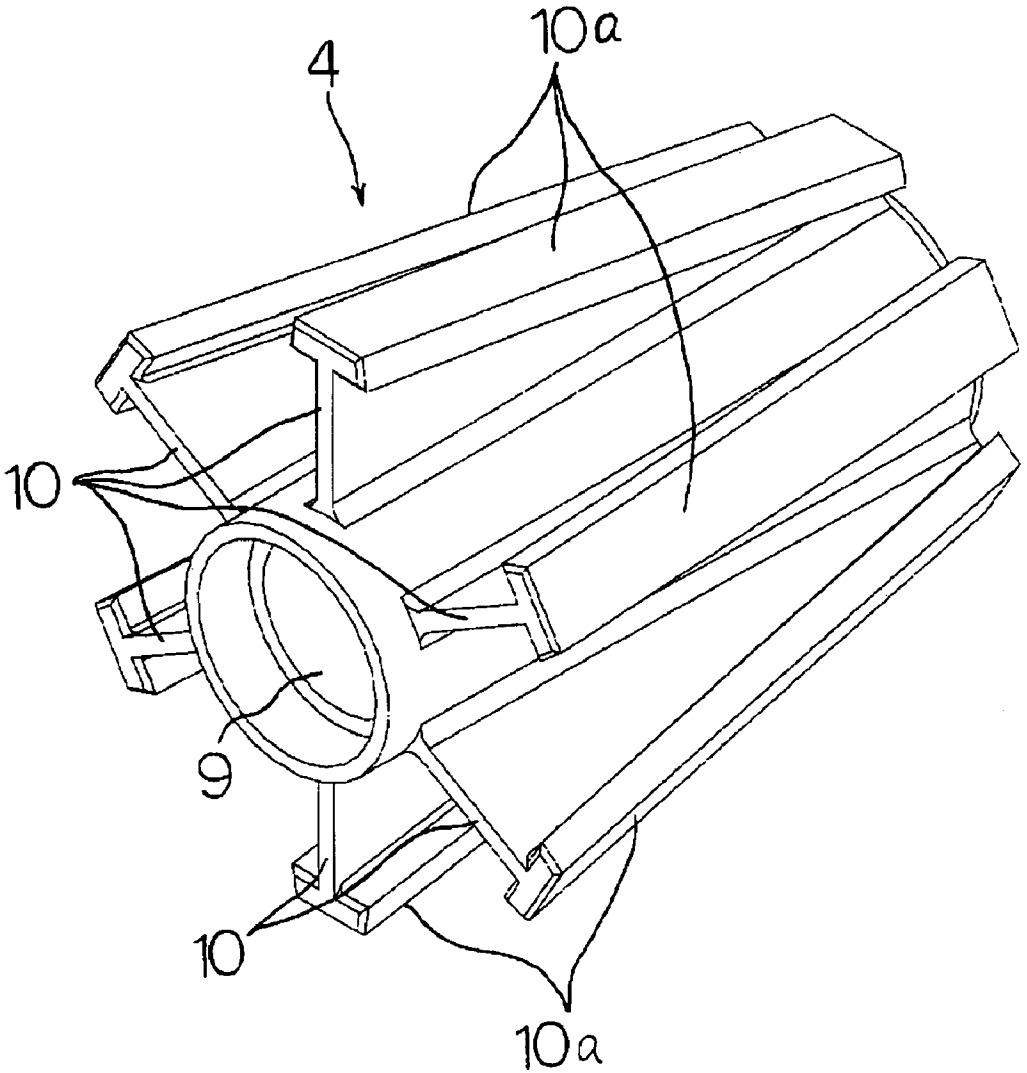
FIG. 5 is a perspective view showing a cam member of the rolled body holder shown in FIG. 1.

The cam member 4 shown in FIG. 5 includes, in an inner peripheral portion thereof, a cylinder part 9 provided with an internal thread part not shown to be screwed onto the external thread part of the center shaft member 3, and a plurality of T-shaped rails 10 projected from an outer peripheral surface of the cylinder part 9. The rails 10 each have a sloped cam surface (sliding surface) 10*a* with a radially varying height. In other words, the cam surface 10*a* of this embodiment is a linear slope continuously formed from a portion (left side of FIGS. 3 and 5) of the cam member 4, which is higher in the radial direction, to a portion (right side of FIGS. 3 and 5) thereof, which is lower in the radial direction. Note that the cam surface maybe, for example, a curved cam surface or a step-like surface having such a small step that can be followed by the follower part. The cam member 4 has a length shorter than that of the center shaft member 3 and is movable along the longitudinal direction of the center shaft member 3. In this embodiment, the external thread part and the internal thread part are screwed to each other. Accordingly, when the handle 8 and the center shaft member 3 are rotated, the cam member 4 advances and retracts in the longitudinal direction of the center shaft member 3.

Figure 6:
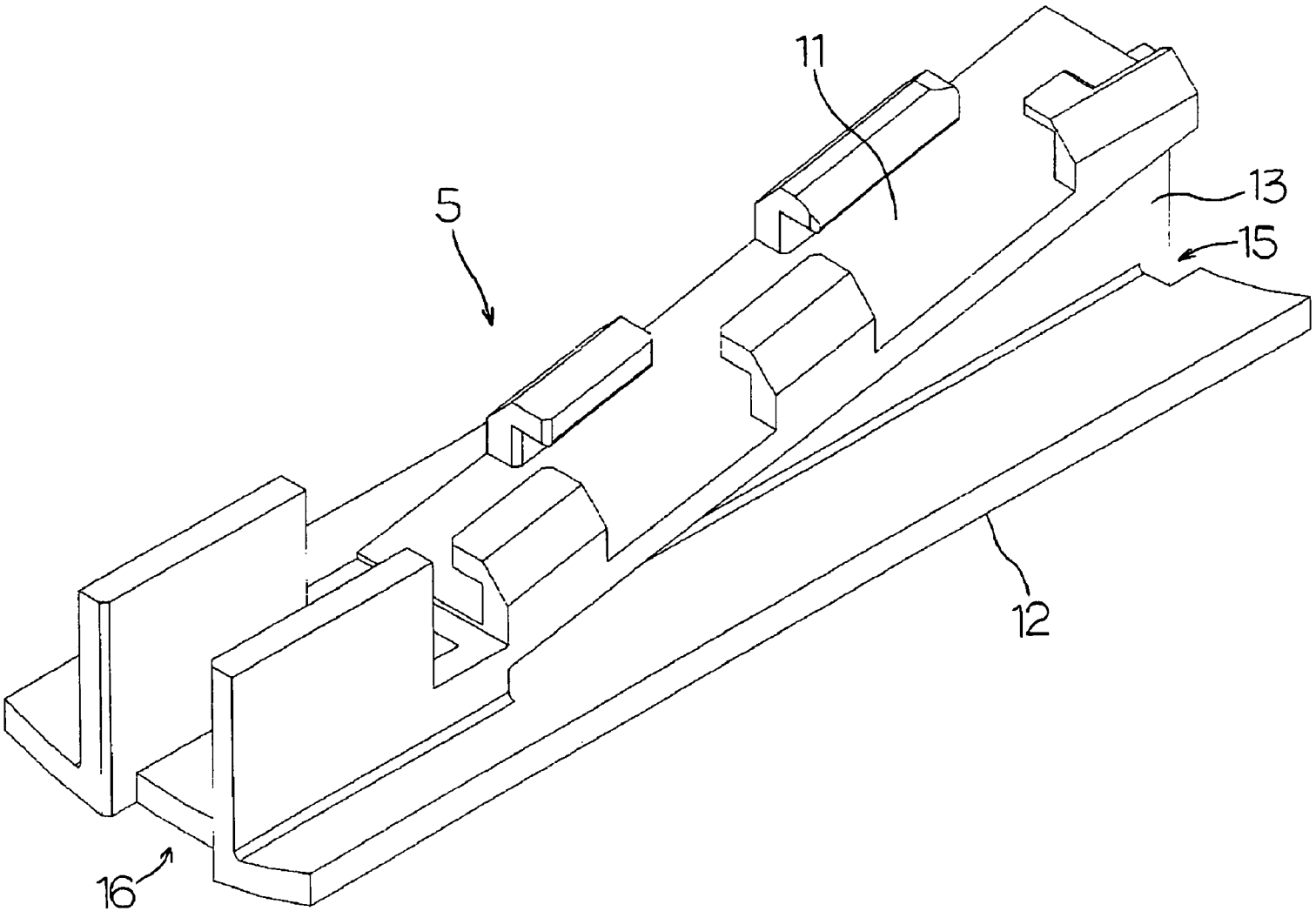
FIG. 6 is a perspective view showing a segment of the rolled body holder shown in FIG. 1.

The segment 5 shown in FIG. 6 includes: a follower part 11, which is fitted into the rail 10 and is relatively slidable along the cam surface 10*a*; an outer surface part 12 which forms the outer peripheral surface of the cylindrical body 2; and a joining part 13 for joining the follower part 11 to the outer surface part 12. In addition, on the outer surface part 12, there are provided multiple rivet-like projections 14 (see FIGS. 1 to 3). Further, there are provided engaging parts 15 and 16 at both end portions of the segment 5 in the longitudinal direction. The segments 5 are sandwiched between the flange land the top plate 6, and each follower part 11 is engaged with each rail 10, whereby the segments 5 are each mounted to the cam member 4. As a result, the segments 5 cannot be disengaged.

The top plate 6 is fixed at a position opposite to the flange 1 with a predetermined interval by screws 17 or the like, and has engaged parts 18 (see FIG. 8) formed on an inner surface thereof and extending in the radial direction. As shown in FIG. 1, a pin 19 is inserted into the center shaft member 3 outside the top plate 6, thereby preventing the top plate 6 and the center shaft member 3 from being disengaged.

Figure 7:
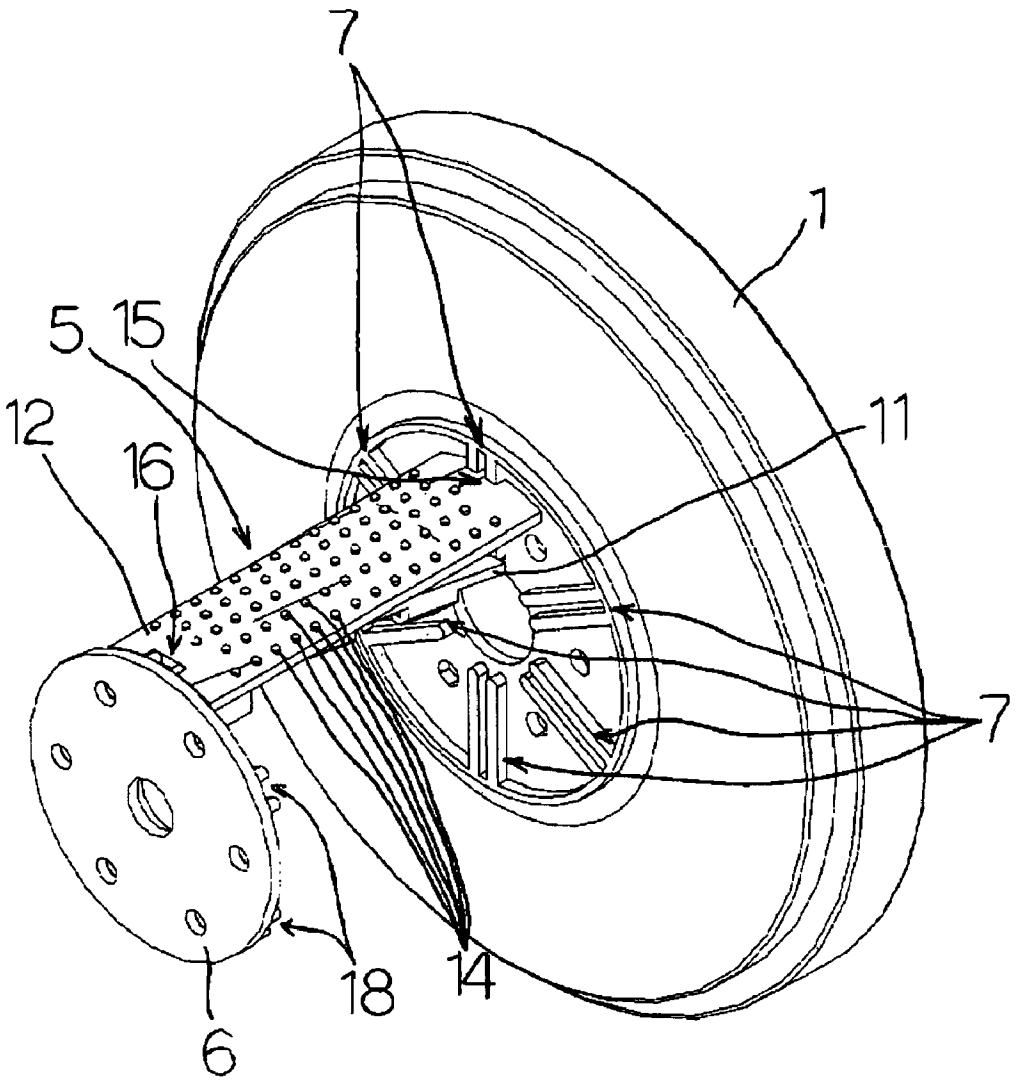
FIG. 7 is a perspective view of the rolled body holder shown in FIG. 1 in which a part of the members is omitted for explaining a state in which the segment is mounted.
Figure 8:
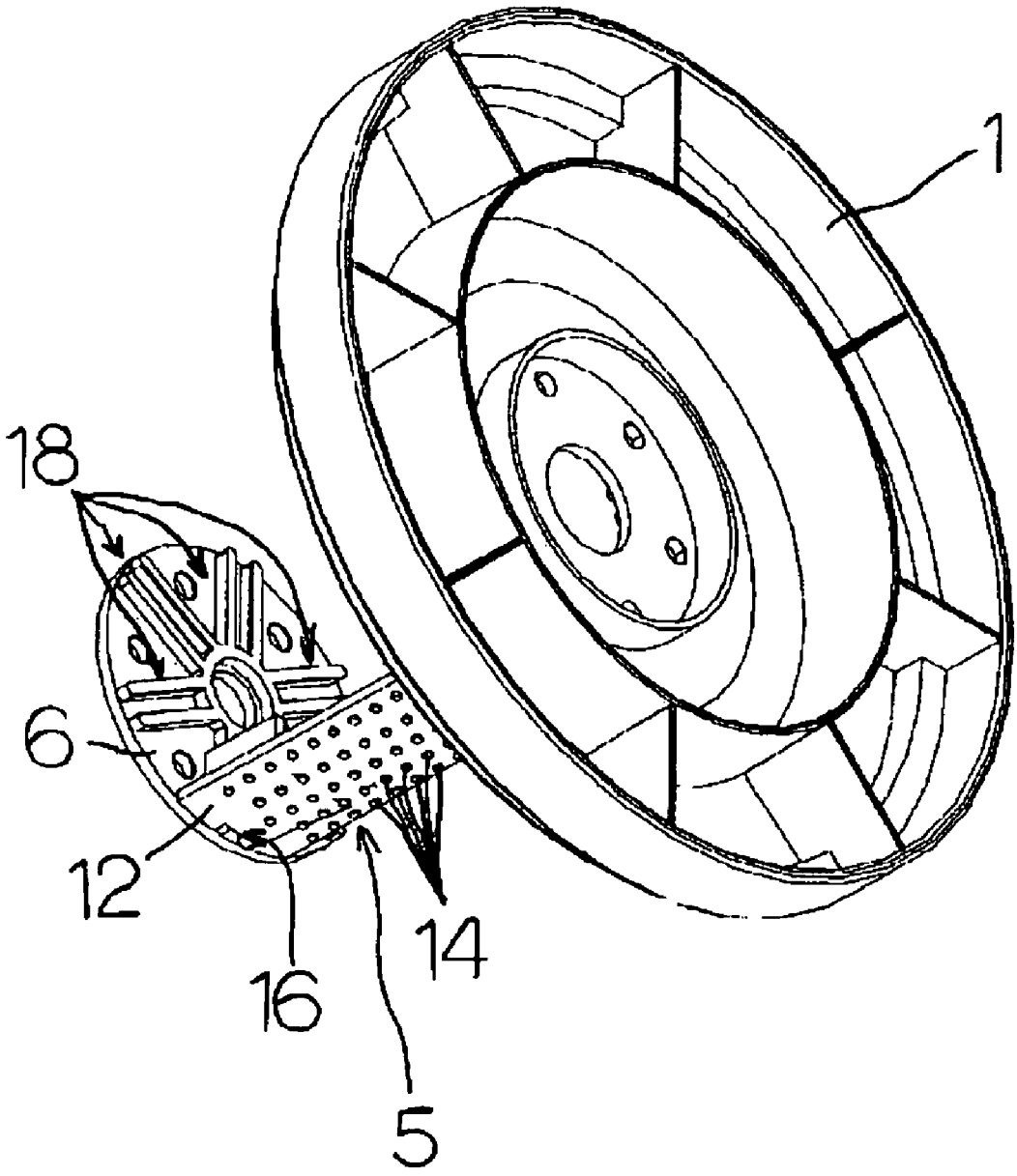
FIG. 8 is a perspective view of the rolled body holder shown in FIG. 1 viewed from a different direction, in which a part of the members is omitted for explaining the state in which the segment is mounted.
Figure 9:
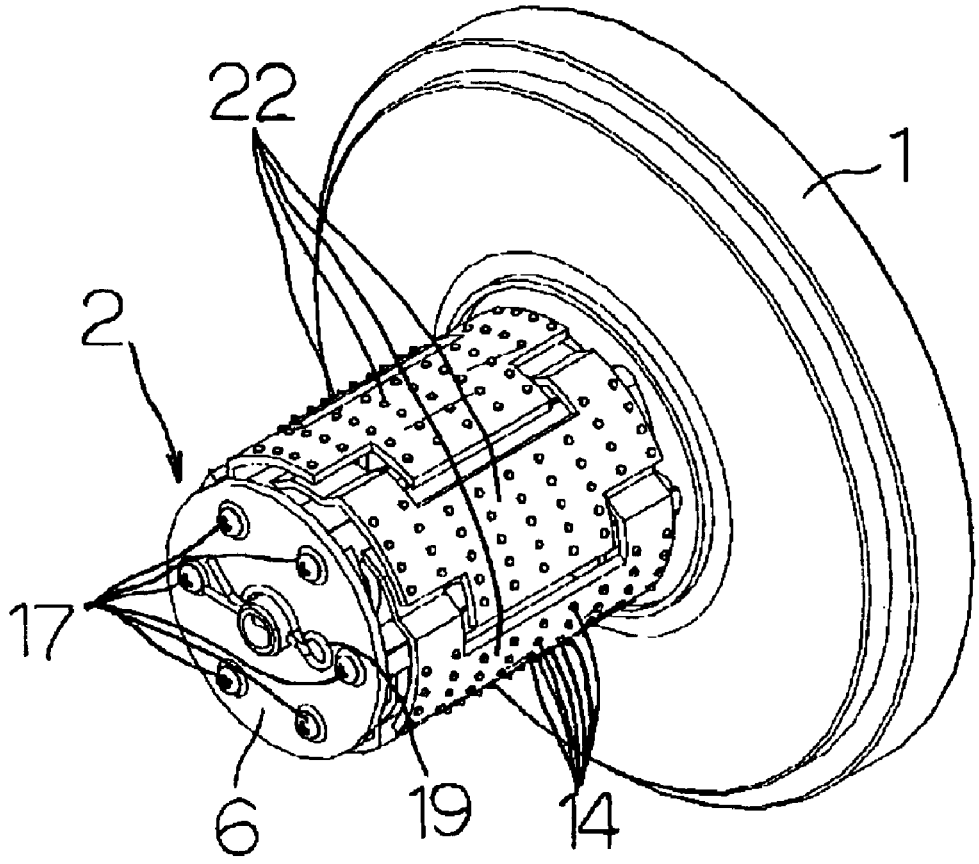
FIG. 9 is a perspective view showing a rolled body holder according to a second embodiment of the present invention.
Figure 10:
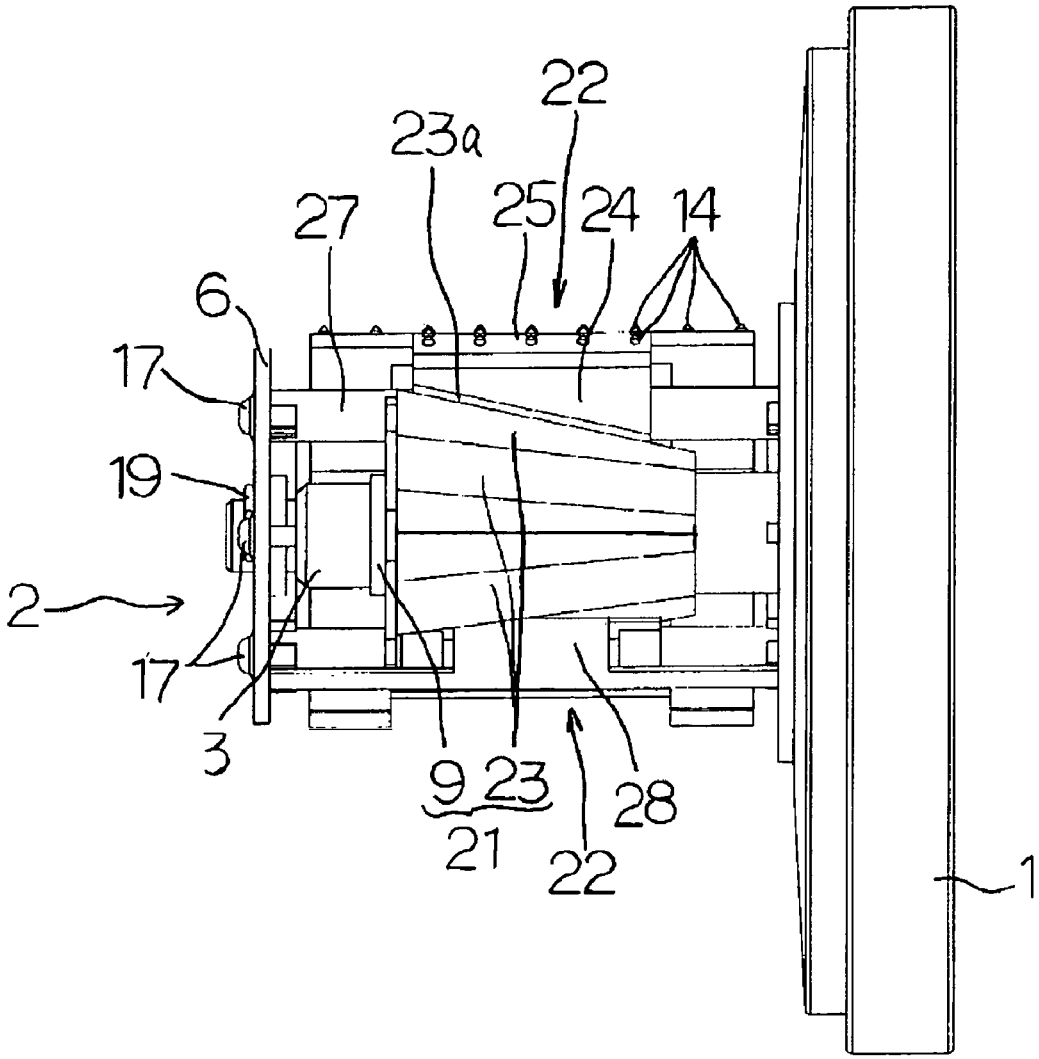
FIG. 10 is a front view of the rolled body holder shown in FIG. 9, in which a part of the segments is omitted.

As shown in FIGS. 7 and 8, the engaged parts 7 provided on the inner surface of the flange land the engaged parts 18 provided on the inner surface of the top plate 6 are each formed of two protrusions and a recess formed therebetween. The engaging parts 15 and 16 provided at the both end portions of the segment 5 in the longitudinal direction are each formed of two recesses and a protrusion formed therebetween. The protrusions and the recesses are fitted to each other, whereby the engaging parts 15 and 16 are each slidable in the radial direction along the engaged parts 7 and 18.

A description is given below of a method of holding a rolled body for the rolled body holder of this embodiment with the above-mentioned structure.

First, in an initial state (not shown) obtained before the rolled body is held, the cam member 4 is held at a position (position near inner surface of top plate 6) apart from the inner surface of the flange 1. Accordingly, the follower part 11 of the segment 5 is brought into contact with a portion of the cam surface 10*a* of the cam member 4, which is relatively lower in the radial direction. For this reason, the segments 5 are each placed at a position retracted in the radial direction. In the initial state, the cylindrical body 2 is inserted into the paper tube 101 (see FIG. 3) of the rolled body 100.

Then, the handle 8 is rotated. When the center shaft member 3 serving as a lead screw is rotated integrally with the handle 8, the cam member 4 moves in the longitudinal direction of the center shaft member 3 because the external thread part and the internal thread part are screwed to each other. Note that, in this embodiment, the center shaft member 3 is fixed between the flange 1 and the top plate 6 so as to be incapable of advancing or retracting, so the cam member 4 moves toward the flange 1 side (rightward in FIG. 3). At this time, the segments 5 are also fixed between the flange 1 and the top plate 6 so as to be incapable of moving in the longitudinal direction, so the cam member 4 slides relatively also with respect to the segments 5. In other words, in this embodiment, the center shaft member 3 and the segments 5 remain fixed in the longitudinal direction, and only the cam member 4 moves in the longitudinal direction. Through the movement of the cam member 4 rightward in the figure, as shown in FIG. 3, the portion of the cam surface 10*a* of the cam member 4, which is relatively higher in the radial direction, is to be brought into contact with the follower part 11 of each of the segments 5. As a result, the segments 5 each extend in the radial direction. The extension of the segments 5 in the radial direction is guided by the engaging parts 15 and 16 and the engaged parts 7 and 18 which are engaged with each other. Such an extended state is shown in FIGS. 1 to 3. At this time, a small gap is formed between each of the outer surface parts 12 of the segments 5. Specifically, a radius of the cylindrical body 2 is extended with a plurality of slits. When the radius of the cylindrical body 2 is extended, as shown in FIG. 3, the multiple projections 14 formed on the outer surface part 12 bite into the inner surface of the paper tube 101 of the rolled body 100. When the multiple projections 14 bite into the inner surface of the paper tube 101 to some extent, it becomes difficult for the projections 14 to bite thereinto more deeply. This means that it becomes difficult for the cylindrical body 2 to extend in the radial direction and that it becomes difficult for the cam member 4 to advance rightward in FIG. 3. As a result, there is shown a state in which it becomes difficult for the center shaft member 3 and the handle 8 to be rotated. An operator can detect the state when feeling it difficult to rotate the handle 8 (resistance to rotation of handle is increased). In this state, the multiple projections 14 enable firm holding of the rolled body 100 without causing wobbling.

In other words, if an inner diameter of the paper tube 101 of the rolled body 100 has an error of about several mm, when the operator rotates the handle 8 until the resistance to rotation of the handle is increased, the multiple projections 14 bite into the paper tube 101 relatively deeply, thereby obtaining a state of firmly holding the rolled body 100. Without the need of measurement of the error, observation with eyes or the like, processes other than the rotation of the handle 8, the rolled body can be firmly held only by the sense of resistance to the handle 8.

In this embodiment, in a case of releasing the holding of the rolled body 100 for replacement or the like of the rolled body, the handle 8 is reversely rotated. When the handle 8 is reversely rotated, the cam member 4 moves leftward in FIG. 3, which is a direction opposite to that described in the above, the portion of the cam surface 10*a* of the cam member 4, which is relatively lower in the radial direction, is brought into contact with the follower part 11 of each of the segments 5. Thus, the segments 5 each retract in the radial direction. As a result, at least a part of the multiple projections 14 is apart from the inner surface of the paper tube 101, thereby making it possible to allow the cylindrical body 2 to be escaped from the inside of the paper tube 101.

Further, if a part of the projections 14 in use is almost apart from the inner surface of the paper tube 101, the handle 8 is rotated in a forward direction again so as to extend the cylindrical body, thereby making it possible to allow the projections 14 to bite into the inner surface of the paper tube 101 again more deeply. Thus, even in a case of increasing holding power in the state where the rolled body is held, the process can be easily performed only through the rotation of the handle without the necessity of other operations.

In this embodiment, the length of each of the cam surfaces 10*a* in the longitudinal direction is equal to or larger than two-thirds of the length of each of the segments 5 and the follower parts 11 in the longitudinal direction. As a result, the segments 5 can smoothly extend or retract in the radial direction without causing scoring.

To explain that point, if the length of the cam surface 10*a* in the longitudinal direction is extremely shorter than that of the segment 5, for example, when a portion of each segment 5, which is pressed toward the outside in the radial direction by sliding of the cam surface 10, and a portion of each segment 5, which does not receive a pressure toward the outside in the radial direction, are present at about the same rate, in particular, when the portion to be pressed to the outside in the radial direction is inclined to one end portion when viewed in the longitudinal direction of the segments 5, there is a fear that the segments 5 lose a balance and are each inclined from a posture parallel to a center axis of the cylindrical body 2 (posture vertical to radial direction). As a result, the segments 5 cannot smoothly slide toward the outside in the radial direction with respect to the flange 1 and the top plate 6. Specifically, the segments 5 are hooked on or stretched against the flange 1 and the top plate 6, with the result that the segments 5 cannot smoothly move in parallel toward the outside in the radial direction. Such an operational failure is called "scoring". When the scoring is caused, the paper tube 101 cannot be held by allowing the multiple projections 14 to uniformly bite into the inner surface of the paper tube 101. Note that, also when the segments 5 move inward in the radial direction, the same operational failure can be caused.

In this embodiment, as described above, the length of the cam surface 10*a* in the longitudinal direction is equal to or larger than two-thirds of the length of each of the segments 5 and the follower parts 5 in the longitudinal direction. Accordingly, almost the entirety of the segments 5 uniformly receives the pressure by the sliding of the cam surface 10*a*. The portion of each of the segments 5, which does not receive the pressure in association with the sliding of the cam surface 10*a*, is extremely small. Accordingly, the segments 5 do not lose a balance, and can smoothly move in parallel toward the outside in the radial direction without being hooked on or stretched against the flange 1 and the top plate 6, that is, without causing scoring, while maintaining the posture parallel to the center axis of the cylindrical body 2 (posture vertical to radial direction). As a result, the paper tube 101 can be held by allowing the plurality of projections 14 to uniformly bite into the inner surface of the paper tube 101.

Note that, in this specification, it is described that the follower part 11 can obtain the state of being brought into contact with the portion of the cam surface 10*a*, which is relatively lower in the radial direction, and the state of being brought into contact with the portion of the cam surface 10*a*, which is relatively higher in the radial direction. In practice, the cam surface 10*a* has a common portion which is brought into contact with the follower part 11 in the both states. However, when the portion in which the follower part 11 is brought into contact with the cam surface 10*a* is viewed as a whole, in the case where the cam member 4 is positioned leftward in FIG. 3 (near top plate 6), the portion relatively lower in the radial direction is engaged with the follower part 11 and the portion particularly higher in the radial direction is not engaged with the follower part 11. On the other hand, when the cam member 4 moves rightward in FIG. 3 (near flange 1), the portion relatively higher in the radial direction is to be engaged with the follower part 11 (state shown in FIG. 3 is obtained).

In this embodiment, when the plurality of segments 5 are uniformly arranged over a perimeter of the cylindrical body 2, the perimeter is uniformly extended or retracted in the radial direction, thereby making it possible to hold the rolled body 100 in a balanced manner without being inclined.

Conventionally, the end portions of the rolled body 100 and the paper tube 101 are abutted against the inner surface of the flange, thereby determining a positional relation between the rolled body holder including the flange, and the rolled body held by the rolled body holder. However, it is difficult to orthogonally abut the end portions against the inner surface due to unevenness of winding of the rolled body 100 or the like in some cases. Further, there is proposed a structure in which one or a small number of engaging projections are allowed to bite into the inside of the paper tube 101 so as to hold the rolled body 100. However, in this case, the rolled body 100 and the paper tube 101 are obliquely held with the engaging projections as a center, in some cases. In either case, when the rolled body 100 and the paper tube 101 are held not orthogonally but obliquely with respect to the flange, there may arise a skew. On the other hand, in the structure of this embodiment, the multiple projections 14 formed on the outer surface part 12 with a relatively large area exist over substantially the entire surface of the outer peripheral surface of the cylindrical body 2 (note that slit-like gaps formed between each of outer surface parts 12, which is generated when the segments 2 extend in radial direction, are excluded). Accordingly, the multiple projections 14 almost uniformly bite into a large range of the inner surface of the paper tube 101. As a result, the rolled body 100 and the paper tube 101 are hardly inclined.

In other words, in the case of holding the rolled body 100 and the paper tube 101 with one or a small number of engaging projections, there is a possibility that the rolled body 100 and the paper tube 101 are substantially supported at a point and lose a balance, whereby the rolled body 100 and the paper tube 101 are obliquely held. On the other hand, in this embodiment, the multiple projections 14 formed on the outer surface part 12 with a large area bite into the inner surface of the paper tube 101 almost at the same time. Accordingly, the rolled body 100 and the paper tube 101 are substantially supported on a surface and are balanced, thereby being vertically held with respect to the flange 1. As a result, the rolled body 100 and the paper tube 101 can be appropriately held without being abutted against the flange 1, thereby making it possible to prevent a skew from occurring. Thus, while the rolled body 100 and the paper tube 101 are vertically held with respect to the flange 1, the rolled body 100 and the paper. tube 101 are held apart from the flange 1 by use of a spacer or the like not shown, thereby making it possible to prevent the rolled body 100 from being brought into contact with the flange 1 to be folded.

Next, referring to FIGS. 9 to 13, a second embodiment of the present invention will be described. Note that structures similar to those of the first embodiment are denoted by the same reference symbols and descriptions thereof are omitted.

A rolled body holder bf this embodiment includes the flange 1 and the cylindrical body 2 as in the first embodiment. Specifically, the center shaft member 3, a cam member 21 (see FIG. 12) mounted to the outer periphery of the center shaft member 3, and a plurality of segments 22 (see FIGS. 11 and 13) which form the cylindrical body 2 covering the center shaft member 3 and the cam member 21 are held between the flange 1 and the top plate 6.

Figure 12:
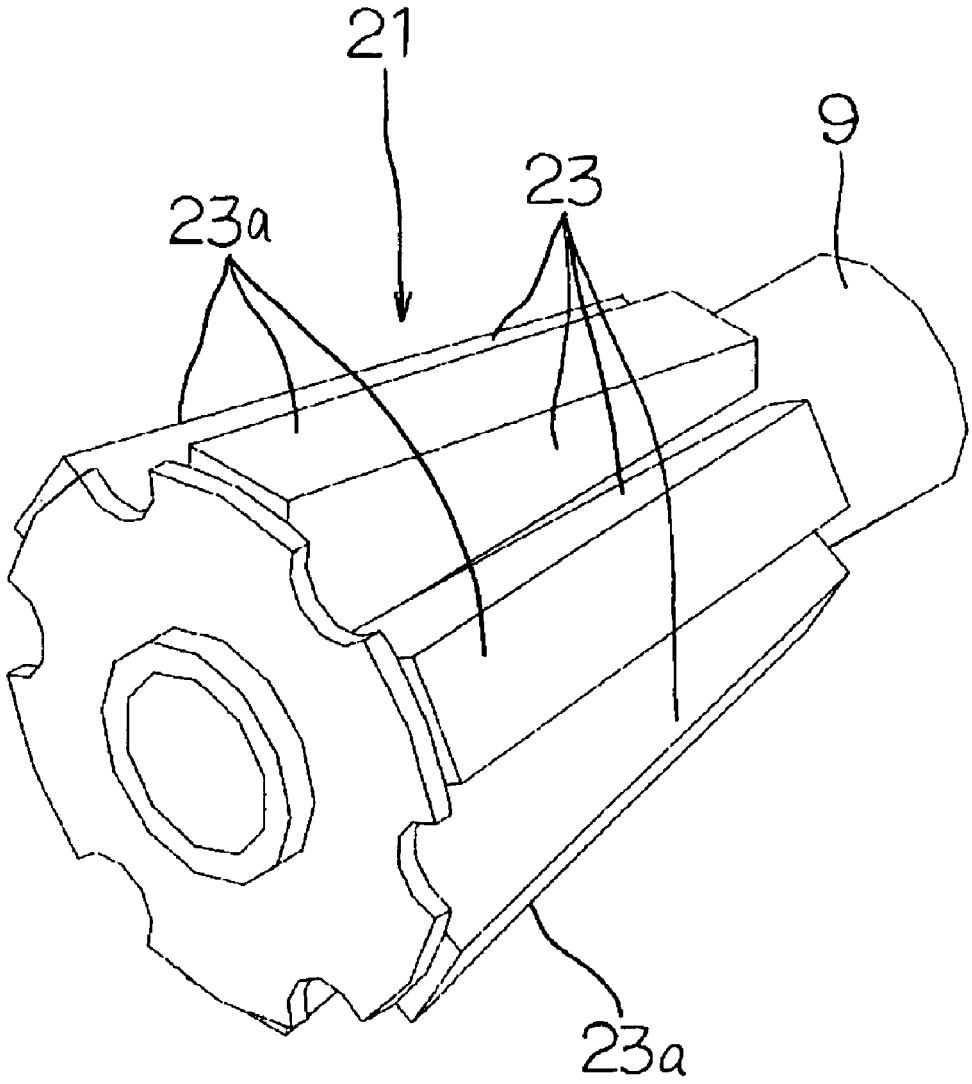
FIG. 12 is a perspective view showing a cam member of the rolled body holder shown in FIG. 9.

As shown in FIG. 12, the cam member 21 of this embodiment has projections 23 projected from an outer peripheral surface of the cylinder part 9. The projections 23 each have a cam surface 23*a* which varies in height in the radial direction.

Figure 11:
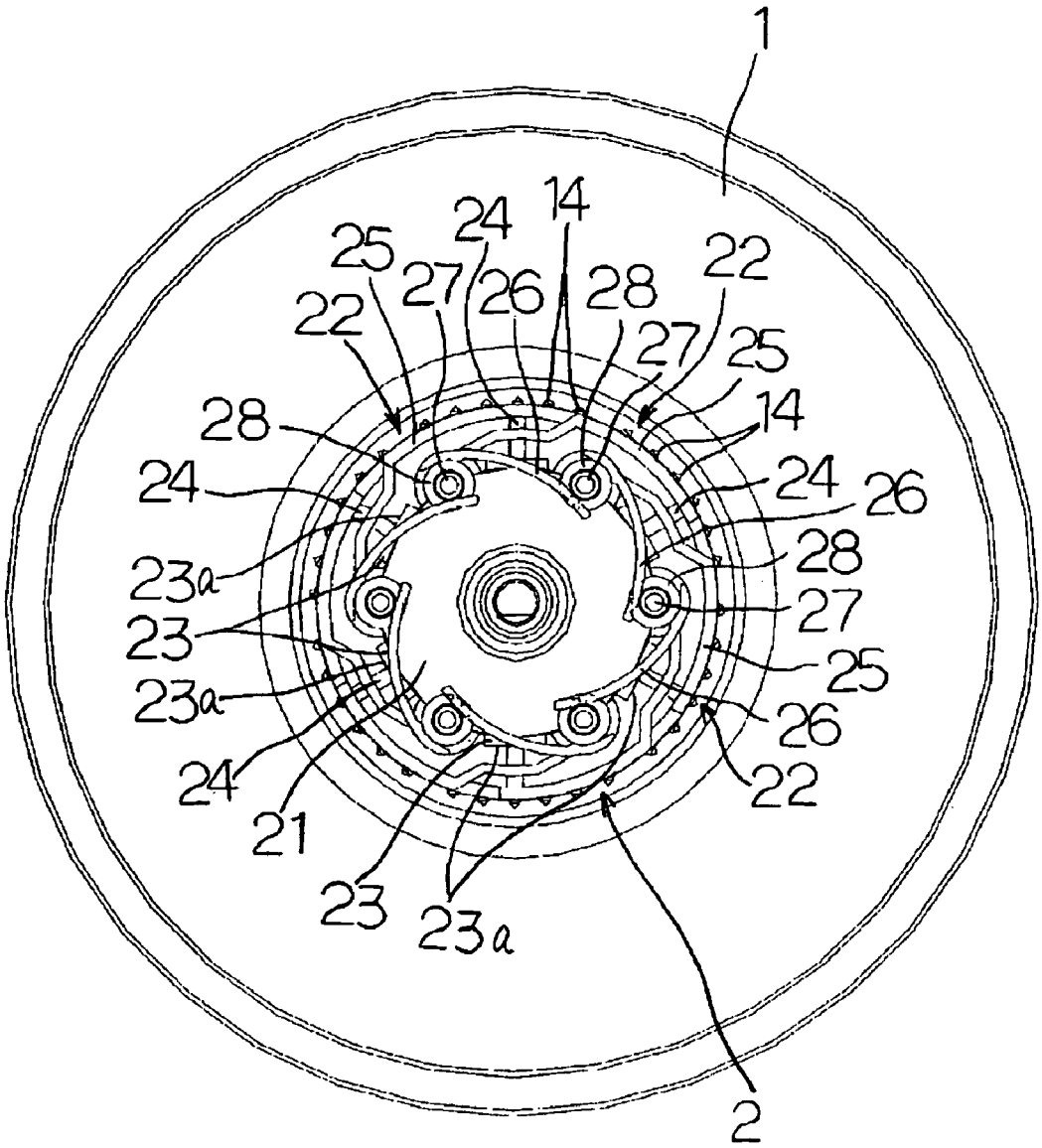
FIG. 11 is a plan view of the rolled body holder shown in FIG. 9, in which a top plate is omitted.
Figure 13:
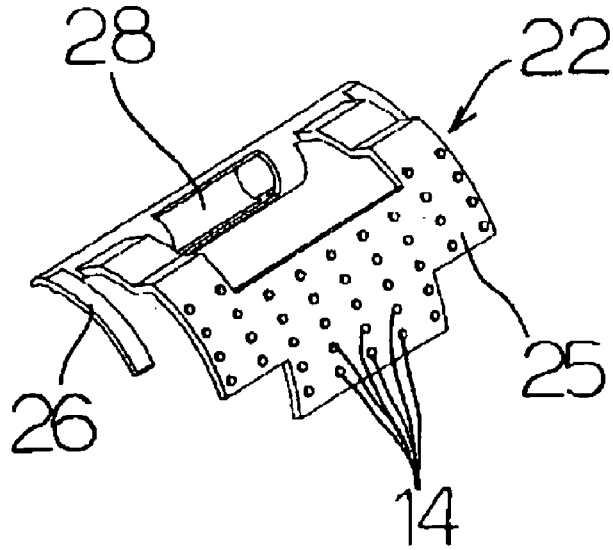
FIG. 13(*a*) is a perspective view of the segment of the rolled body holder shown in FIG. 9 viewed from a side of an outer surface part, and FIG. 13(*b*) is a perspective view of the segment of the rolled body holder shown in FIG. 9 viewed from a side of a follower part.
Figure 13:
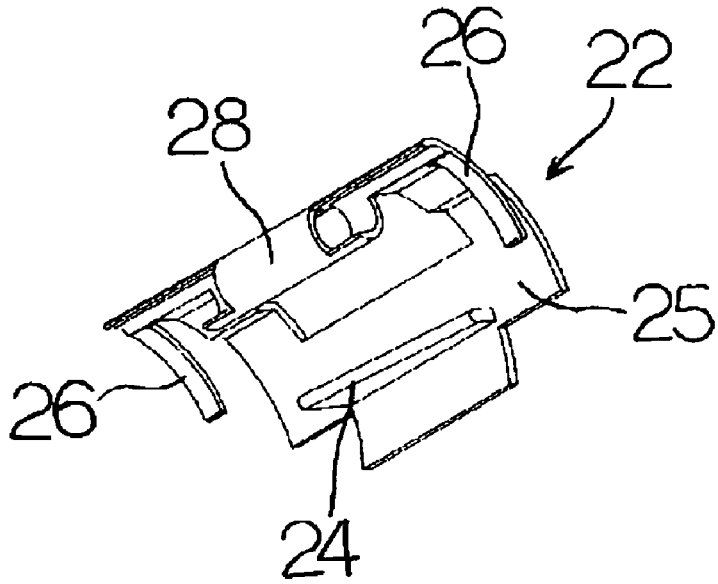

On the other hand, as shown in FIGS. 11 and 13, the segments 22 of this embodiment each include: a follower part 24 which is brought into contact with the cam surface 23*a* of the cam member 21 and is relatively slidable along the cam surface 23*a*; an outer surface part 25 which forms the outer peripheral surface of the cylindrical body 2; a plate spring part 26 integrally joined to the outer surface part 25; and a bearing part 28 to which a support shaft 27 (see FIG. 11) fixed to the top plate 6 and the flange 1 is fitted. The outer surface part 25 has multiple spiny projections 14 formed thereon. The segments 22 each have the bearing part 28 into which the support shaft 27 is inserted, and is slidable with the bearing part 28 and the support shaft 27 as a center. A part of the plate spring part 26 is hung on the bearing part 28 of the adjacent segment 22 and on the support shaft 27 fitted with the bearing part 28. The outer surface parts 25 of the plurality of segments 22 are connected to each other with predetermined intervals, thereby forming the perimeter of the cylindrical body 2. Note that the segments 22, the flange 1, and the top plate 6 are not provided with the engaging parts 15 and 16 and the engaged parts 7 and 18 unlike the first embodiment of the present invention.

A description is given of a method of holding the rolled body for the rolled body holder of this embodiment. First, as in the first embodiment of the present invention, in the initial state in which the segments 22 retract in the radial direction, the cylindrical body 2 is inserted into the paper tube 101 (see FIG. 3) of the rolled body 100. Then, the handle 8 is rotated so as to rotate the center shaft member 3, thereby moving the cam member 21 in the longitudinal direction of the center shaft member 3. Thus, a portion of the, cam surface 23*a* of the cam member 21, which is relatively higher in the radial direction, is brought into contact with the follower part 24 of each of the segments 22. As a result, the segments 22 each swing with the bearing part 28 and the support shaft 27 as a center, and the outer surface parts 25 extend in the radial direction. Accordingly, the multiple projections 14 formed on the outer surface part 25 bite into the inner surface of the paper tube 101 of the rolled body 100. Thus, the multiple projections 14 enable firm holding of the roller body 100 without causing wobbling.

In the case of releasing the holding of the rolled body 100, the handle 8 is reversely rotated so as to move the cam member 21, whereby the portion of the cam surface 23*a* of the cam member 21, which is relatively lower in the radial direction, is brought into contact with the follower part 24 of each of the segments 22. Then, the segments 22 swing by a spring property of the spring part 26 with the bearing part 28 and the support shaft 27 as a center to return to an initial position, that is, to retract in the radial direction. Thus, at least a part of the multiple projections 14 is apart from the inner surface of the paper tube 101, thereby making it possible to allow the cylindrical body 20 to be escaped from the inside of the paper tube 101.

As described above, in the first embodiment of the present invention, the follower part 11 is inseparably engaged with the rail 10. As a result, in accordance with the advancement and retraction of the cam member 4 with the forward and reverse rotation of the handle 8, the segments 5 radially extend and retract. On the other hand, in the second embodiment of the present invention, the follower part 24 is merely brought into contact with the cam surface 23*a*. However, in the case of radially extending the segments 22, the cam member 21 can be used, and in the case of radially retracting the segments 22 to be returned to the initial state, the spring property of the plate spring part 26 can be used. In either embodiment, the operation of radially extending and retracting the segments 5 and 22, that is, the operation of firmly holding and releasing the holding of the rolled body 100 can repeatedly performed only through the operation of rotating the handle 8 without the need of performing an adjustment operation or the like during the operation.

Figure 14:
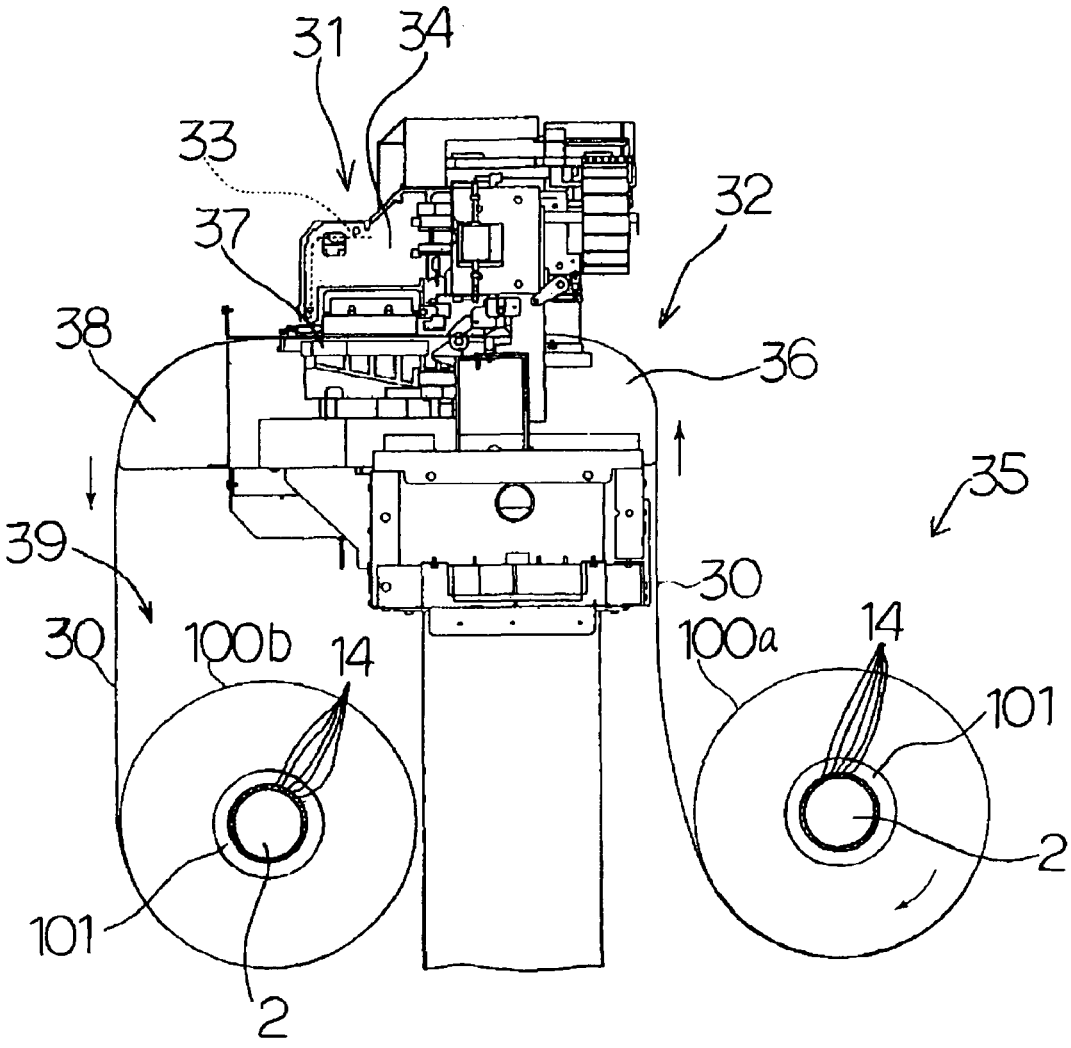
FIG. 14 is a front view showing an example of a recording apparatus to which the rolled body holder according to the present invention is applied.

Next, a description is given of an example of a recording apparatus to which the above-mentioned rolled body holder according to the first embodiment or the second embodiment of the present invention is applied, with reference to FIG. 14. The recording apparatus is, for example, an inkjet printer for performing printing on a recording medium 30 made of paper, synthetic resin, or the like having a relatively large width of about 0.5 m to 2 m. The inkjet printer includes a recording unit 31 for performing recording on the recording medium 30, and a transport unit 32 for transporting the recording medium 30 to be recorded with the recording unit 31.

The recording unit 31 includes a recording head 33 for discharging ink droplets onto the recording medium 30, and a head movement mechanism for allowing the recording head 33 to scan in a width direction orthogonal to a transport direction of the recording medium 30. The head movement mechanism includes a carriage 34 for holding the recording head 33, a guide rail (not shown) for movably guiding the carriage 34 in the width direction of the recording medium 30, and a drive motor (not shown) for driving the carriage 34 along the guide rail.

The transport unit 32 includes, in order of appearance along a transport path for the recording medium 30, a supply part 35 for supporting a rolled body 100*a* for supply, which supplies the recording medium 30, a front paper guide 36 for guiding the recording medium 30 to be transported on the recording head 33 side, a platen 37 for supporting the recording medium 30 to be recorded with the recording head 33, a rear paper guide 38 for guiding the recording medium 30 to be transported from the recording head 33 side, and a winding part 39 for supporting a rolled body 100*b* for winding, around which the recording medium 30 recorded with the recording head 33 is wound. In this embodiment, the transport unit 32 itself does not include a feed mechanism for transporting the recording medium 30, and merely supports the rolled bodies 100*a* and 100*b* so as to be capable of rotating with the movement of the recording medium 30 with rotation of a transport roller (not shown) provided near the recording head.

The supply part 35 and the winding part 39 each include the above-mentioned rolled body holder according to the first embodiment and the second embodiment of the present invention so as to support each paper tube 101 of the rolled body 100*a* and 100*b* which are each formed of the recording medium 30 wound around the paper tube 101. FIG. 14 schematically shows only the cylindrical bodies 2 and the projections 14 of the rolled body holder. The supply part 35 and the winding part 39 further include support structures (not shown) for supporting the rolled bodies 100*a* and 100*b* and the rolled body holders, respectively. The rolled body holders are disposed at both end portions of the rolled bodies 100*a* and 100*b*. Note that, in this embodiment, there is employed the structure in which both the rolled bodies 100*a* and 100*b* are rotated together with the movement of the recording medium 30 as described above. Meanwhile, there may be employed a feed mechanism for positively feeding the recording medium 30, for example, a structure including a drive mechanism (not shown) for intermittently rotating the rolled bodies 100*a* and 100*b*.

With the structure, the rolled body 100*a* for supply is firmly held by using the rolled body holder according to the present invention, thereby making it possible to smoothly supply the recording medium 30 without causing a skew and to perform desired recording. In addition, the rolled body 100*b* for winding is firmly held by using the rolled body holder according to the present invention, thereby making it possible to smoothly wind the recording medium 30. Further, by an extremely simple operation, mounting and dismounting of the rolled bodies 100*a* and 100*b* can be repeatedly performed.

Note that, in the example shown in FIG. 14, both the rolled body 100*a* for supply and the rolled body 100*b* for winding are held by using the rolled body holder, but there may be provided a structure for holding only one of the rolled bodies by using the rolled body holder according to the present invention.

INDUSTRIAL APPLICABILITY

According to the present invention, a rolled body can be held with a simple structure, and an operation of mounting and dismounting the rolled body can be performed by an extremely simple operation.

The invention claimed is:

1. A rolled body holder, comprising:

a center shaft member;

a cam member which is provided along a longitudinal direction of the center shaft member so as to be capable of advancing and retracting, and which has a cam surface with a radially varying height; and a plurality of segments each including a follower part mounted so as to be brought into contact with the cam surface and relatively slidable along the cam surface of the cam member, an outer surface part which forms a part of a cylindrical body covering the center shaft member and the cam member, and a plurality of projections formed on the outer surface part, the plurality of segments being incapable of moving in the longitudinal direction of the center shaft member and being capable of moving in a radial direction of the cylindrical body with relative sliding of the follower part along the cam surface;

a flange for holding the center shaft member and the cam member so that the cam member can move within a predetermined range in the longitudinal direction of the center shaft member, and for holding the plurality of segments so that the outer surface parts form the cylindrical body covering the center shaft member and the cam member and so that each of the segments is incapable of moving in the longitudinal direction of the center shaft member and each of the segments is capable of moving within the predetermined range in the radial direction of the cylindrical body, wherein the plurality of segments each include a plate spring part joined to the outer surface part, for urging the segment from a position where the segment extends in the radial direction toward a position where the segment retracts in the radial direction.

2. The rolled body holder according to claim 1, wherein the projections exist over substantially an entire surface of an outer peripheral surface of the cylindrical body.

3. The rolled body holder according to claim 1, wherein the center shaft member has a screw part, is joined to a handle disposed outside the flange, is rotated with rotation of the handle, and is capable of allowing the cam member fitted into the screw part to advance and retract.

4. The rolled body holder according to claim 1; wherein the cam surface of the cam member forms a part of rails; the follower part is mounted slidably and inseparably with respect each of the rails; the flange includes a plurality of engaged parts along the radial direction; and the segments each include slidable engaging parts to be engaged with the engaged parts.

5. The rolled body holder according to claim 1; wherein the segments are placed at positions where the segments retract in the radial direction in a state where the follower part is brought into contact with a portion of the cam surface, which is relatively lower in the radial direction; and the segments are placed at positions where the segments extend in the radial direction in a state where the follower part is brought into contact with a portion of the cam surface, which is relatively higher in the radial direction.

6. The rolled body holder according to claim 1; wherein a length of the cam surface in the longitudinal direction is equal to or larger than two-thirds of a length of each of the segments and the follower part in the longitudinal direction.

7. A recording apparatus, comprising:

the rolled body holder according to claim 1; and a recording part for performing recording on a recording medium fed from a rolled body held by the rolled body holder.

8. The rolled body holder according to claim 1, wherein the plurality of segments each comprise an integral structure.

9. The rolled body holder according to claim 1, wherein the plate spring part of each segment is pivotally supported on a support shaft fixed to the flange.

* * * * *